US009216854B2

(12) United States Patent
Schreiber

(10) Patent No.: US 9,216,854 B2
(45) Date of Patent: Dec. 22, 2015

(54) CARTRIDGE CONTAINING BREWABLE SUBSTANCE

(71) Applicant: Eugene Schreiber, Brooklyn, NY (US)

(72) Inventor: Eugene Schreiber, Brooklyn, NY (US)

( * ) Notice: Subject to any disclaimer, the term of this patent is extended or adjusted under 35 U.S.C. 154(b) by 229 days.

(21) Appl. No.: 13/716,687

(22) Filed: Dec. 17, 2012

(65) Prior Publication Data

US 2014/0170269 A1 Jun. 19, 2014

(51) Int. Cl.
*B65D 85/804* (2006.01)

(52) U.S. Cl.
CPC ..... *B65D 85/8043* (2013.01)

(58) Field of Classification Search
None
See application file for complete search history.

(56) References Cited

U.S. PATENT DOCUMENTS

| | | | | |
|---|---|---|---|---|
| 2,828,789 | A | 4/1958 | Geisler et al. | 220/783 |
| 4,859,337 | A * | 8/1989 | Woltermann | 210/474 |
| D333,755 | S | 3/1993 | Oleksiuk | D7/400 |
| D341,059 | S | 11/1993 | Watson | D7/400 |
| 5,325,765 | A | 7/1994 | Sylvan et al. | 99/295 |
| 5,840,189 | A | 11/1998 | Sylvan et al. | 210/474 |
| D426,160 | S | 6/2000 | Lindsay et al. | D9/500 |
| D452,633 | S | 1/2002 | Valkovich | D7/400 |
| D474,110 | S | 5/2003 | Sweeney | D9/428 |
| D474,111 | S | 5/2003 | Lazaris | D9/428 |
| 6,645,537 | B2 | 11/2003 | Sweeney et al. | 426/79 |
| D524,691 | S | 7/2006 | Caruso | D11/152 |
| D546,140 | S | 7/2007 | Anzalone | D7/672 |
| D606,363 | S | 12/2009 | Aardenburg | D7/400 |
| D607,329 | S | 1/2010 | Diss | D9/500 |
| D652,266 | S | 1/2012 | Smyers | D7/630 |
| D695,110 | S | 12/2013 | Houlton et al. | D9/500 |
| D710,686 | S | 8/2014 | Gowens | D9/429 |
| D715,649 | S | 10/2014 | O'Brien | D9/500 |
| 2009/0205504 | A1 | 8/2009 | Navarro Alcantara | 99/295 |
| 2010/0003371 | A1 | 1/2010 | Ozanne et al. | 426/77 |
| 2010/0108541 | A1 | 5/2010 | Roberto | 206/0.5 |
| 2010/0203198 | A1 | 8/2010 | Yoakim et al. | 426/80 |
| 2011/0303095 | A1* | 12/2011 | Fu et al. | 99/317 |

FOREIGN PATENT DOCUMENTS

WO WO 2013/043048 3/2013

OTHER PUBLICATIONS

Concise Statement of Relevance for U.S. Patent Application Publication No. 2010/0108541, U.S. Patent Application Publication No. 2010/0203198 and PCT Publication No. WO 2013/043048.
U.S. Office Action issued in related Design U.S. Appl. No. 29/430,408.

* cited by examiner

*Primary Examiner* — Benjamin Kurtz
(74) *Attorney, Agent, or Firm* — Ostrolenk Faber LLP

(57) ABSTRACT

Disclosed is a cartridge for retaining a mass of, for example, ground coffee, that includes a cup, a filter, and a cage that supports the filter inside the cup.

14 Claims, 5 Drawing Sheets

CARTRIDGE CONTAINING BREWABLE SUBSTANCE

RELATED APPLICATION

The present application is related to U.S. patent application Ser. No. 13/594,079, (inventor, Eugene Schreiber) entitled Cartridge Containing Brewable Substance the entire disclosure of which is incorporated by reference.

FIELD OF THE INVENTION

The present invention relates to a cartridge arrangement for storing and brewing a brewable substance such as, for example, a mass of ground coffee.

BACKGROUND OF THE INVENTION

Brewing machines for brewing coffee are well known. One well known brewing machine, which is disclosed in U.S. Pat. No. 5,325,765, is configured to receive a cartridge that contains a mass of brewable substance such as coffee. The cartridge includes a fluid impermeable cup made from a flexible plastic inside of which a filter is disposed. The filter, which is shaped like a cup or a cone, is directly joined to the interior wall of the cup at the top edge of the cup, which defines the mouth of the cup. The brewable substance is deposited inside the filter and the mouth of the cup is closed with a metal foil, which is joined to a radially extending flange residing at the mouth of the cup.

To brew the brewable substance, the machine disclosed in U.S. Pat. No. 5,325,765 is configured to inject hot water into the cartridge with a means that pierces the foil. Exposure to the hot water so injected for a short period of time brews the substance inside the cartridge to produce a brewed beverage (e.g. coffee). The brewed beverage passes through the filter and is deposited at the bottom of the cup. Thereafter, the machine disclosed in U.S. Pat. No. 5,325,765 pierces the bottom of the cup allowing the brewed beverage to exit.

Keurig, Inc., the assignee of U.S. Pat. No. 5,325,765, markets a machine according to U.S. Pat. No. 5,325,765 as well as cartridges for use with that machine. U.S. Pat. No. 5,840,189, also assigned to Keurig, Inc., discloses a cartridge for use with the machine disclosed in U.S. Pat. No. 5,325,765.

The cartridges marketed by Keurig, Inc. for use with the Keurig machines are slightly different in configuration than the cartridges disclosed in U.S. Pat. No. 5,840,189. FIG. 1 illustrates a cross-sectional view of a cartridge 10 marketed by Keurig, Inc. Referring to FIG. 1, cup 12 of cartridge 10 includes a frustoconical bottom portion 14 having a closed bottom 16 and an open top 18 defined by a top edge 19. An endless, annular wall 20, which may be cylindrical, is joined at its bottom edge 22 to edge 19 of frustoconical bottom portion 14 via an intermediate, endless, annular, flange portion 24. Intermediate flange portion 24 extends radially away from the interior of frustoconical bottom portion 14 and surrounds top edge 19 of frustoconical bottom portion 14 and its top edge 19. Wall 20 terminates at a top edge 21, which defines the open mouth of cup 12. Top edge 21 is joined with a top flange 26 that extends away from the interior of wall 20 in a radial direction. Foil 28 is joined with top flange 26. A cup shaped filter 30 extends from top edge 21 of wall 20 to a depth less than the depth of cup 12, whereby bottom 31 of filter 30 is spaced from closed bottom 16 of cup 12. A portion of filter 30 extending from its top edge 33 is directly joined to an interior surface of wall 20 as illustrated in FIG. 1.

SUMMARY OF THE INVENTION

It is an object of the present invention to provide a new cartridge that can include a brewable substance such as coffee or the like.

It is yet another object of the present invention to provide a cartridge suitable for use with a machine as described above.

A cartridge according to the present invention includes a filter body, which resides in a fluid impermeable cup, but is not joined directly with its interior surface. Rather, a novel cage is provided to support the filter body inside of the cup.

A cartridge for retaining a mass according to the present invention includes a fluid impermeable cup having an interior space, and a retainer that includes a fluid permeable filter that retains a mass and is joined to a cage. The filter and the cage are received in the interior space of the cup and the cage rests against an interior surface of the cup to support the filter inside the interior space of the cup. Preferably, neither the filter nor the cage extends outside of the interior space of the cup.

In the preferred embodiment, the cage includes a ring portion having an exterior surface that makes intimate contact (i.e. surface to surface contact) with an interior surface of the cup. The cage further includes a base section and a plurality of spaced elongated connectors that connect the base section to the ring portion. Preferably, the base section is a cross-shaped web and the connectors extend from each of the ends of the cross-shaped web and are thus evenly spaced from one another. The spaces between the connectors and the spaces inherently defined by the cross-shaped web allow for the entry of hot fluid into the cage and out of the cage.

In the preferred embodiment, the filter is received interiorly of the ring portion and includes a top portion that is joined with the ring portion and a bottom portion which may be joined with the base section of the cage. Preferably, the filter is configured to be a pouch or a cone having a top portion that includes the edge defining the mouth of the pouch or the cone for receiving the mass inside the filter. In the preferred embodiment, the top portion of the filter is joined to a radially oriented annular surface of the ring portion of the cage.

In the preferred embodiment, the cup includes a flange portion radially extending away from the interior space of the cup. The cage is preferably configured so that the radially oriented surface of its ring portion to which the filter is joined is spaced from the flange portion. A foil or the like may be joined with the flange thereby closing the interior space of the cup, and defining a space above the radially oriented surface of the ring portion.

The ring portion of the cage may be dimensioned to realize intimate contact (i.e. surface to surface contact) with the interior surface of the cup so that fluid does not pass between the cage and the interior surface of the cup. The cage is preferably a unitary body.

Other features and advantages of the present invention will become apparent from the following description of the invention which refers to the accompanying drawings.

BRIEF DESCRIPTION OF THE DRAWING(S)

DETAILED DESCRIPTION

Figure 1:
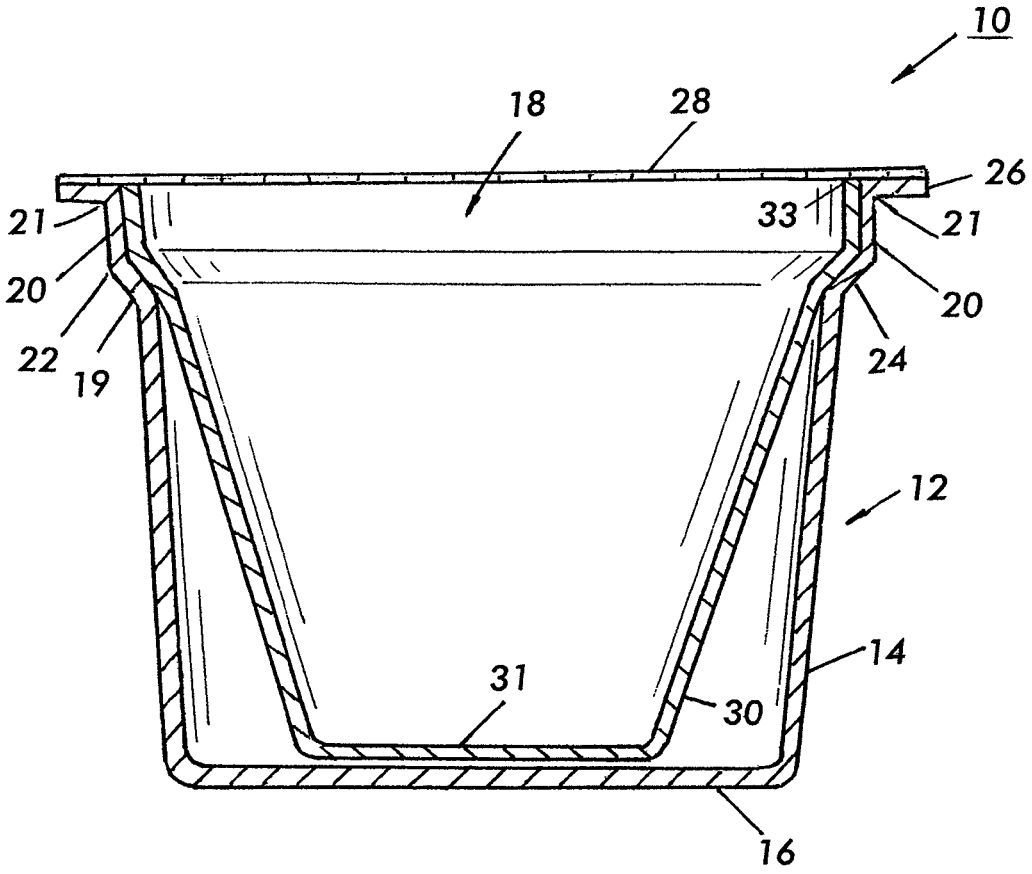
FIG. 1 (Prior Art)
FIG. 1 illustrates a cross-sectional view of a cartridge marketed by Keurig, Inc.
Figure 2:
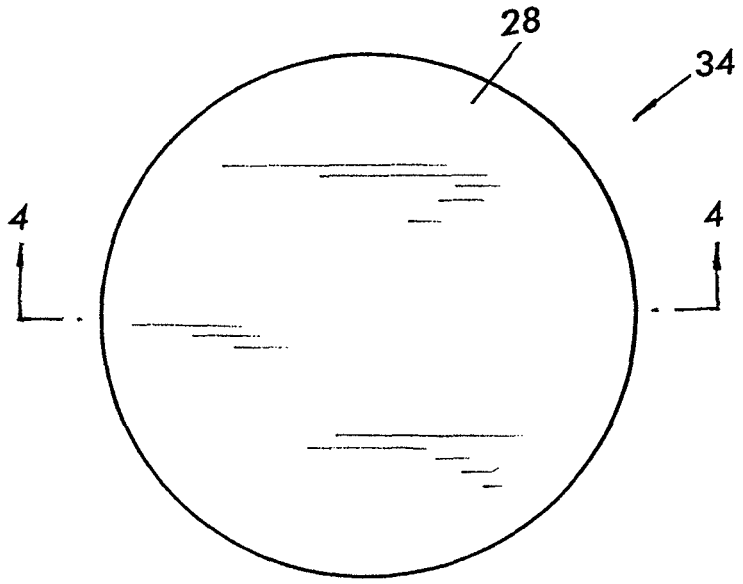
FIG. 2 illustrates a top plan view of a cartridge according to the present invention.
Figure 3:
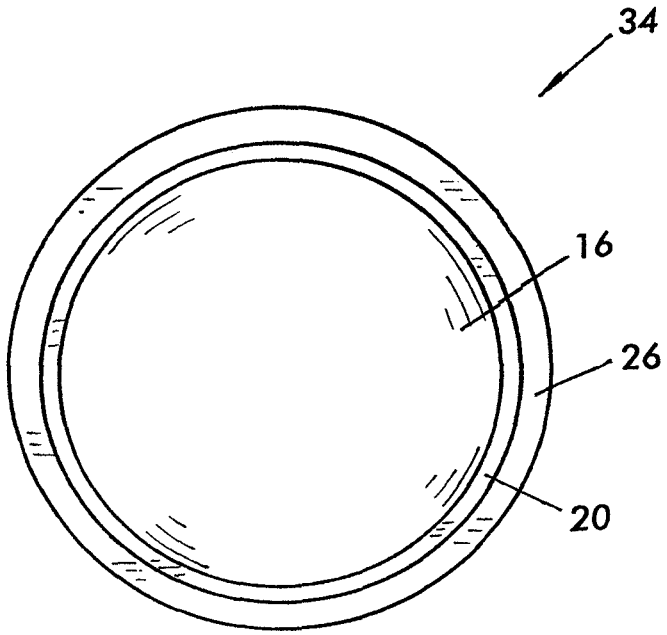
FIG. 3 illustrates a bottom plan view of a cartridge according to the present invention.
Figure 4:
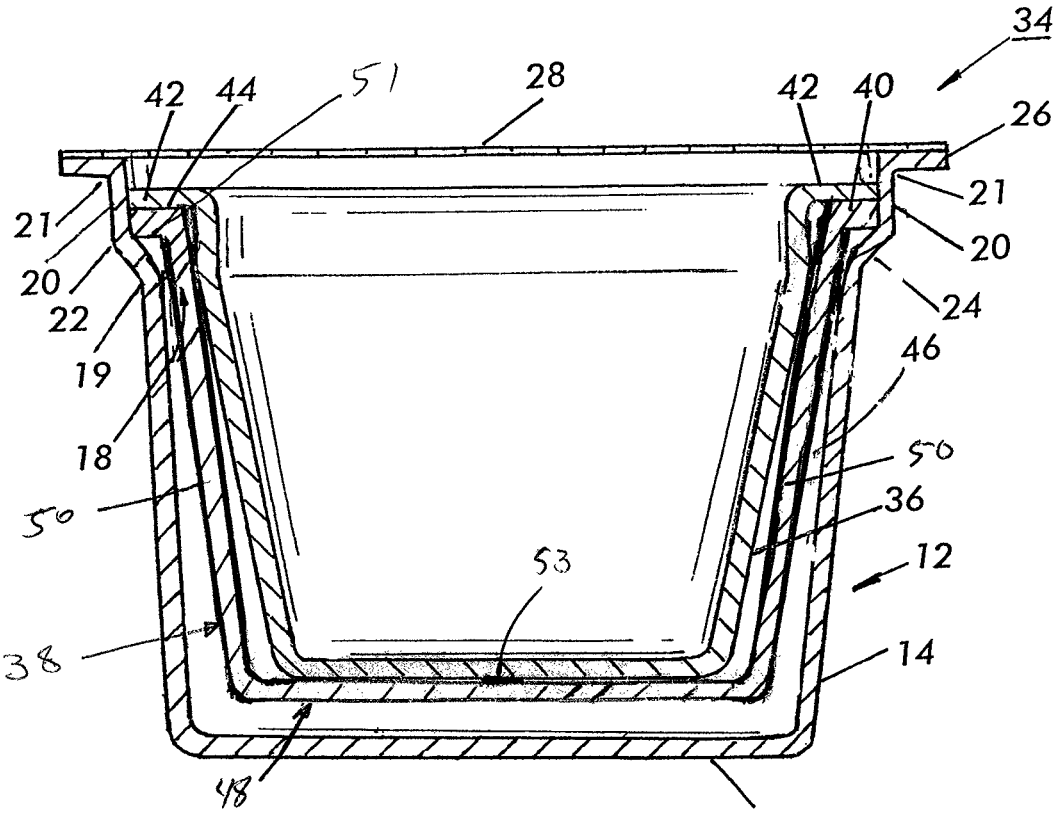
FIG. 4 illustrates a cross-sectional view of a cartridge according to the present invention along line 4-4 in FIG. 2 viewed in the direction of the arrows.
Figure 6:
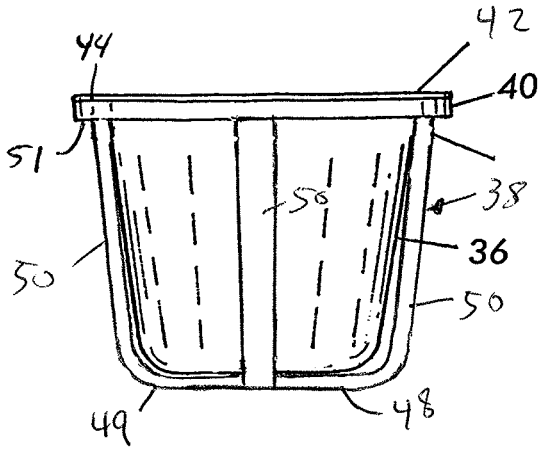
FIG. 6 illustrates a side plan view of a retainer that includes a cage according to the present invention and a filter integrated with the cage.
Figure 5A:
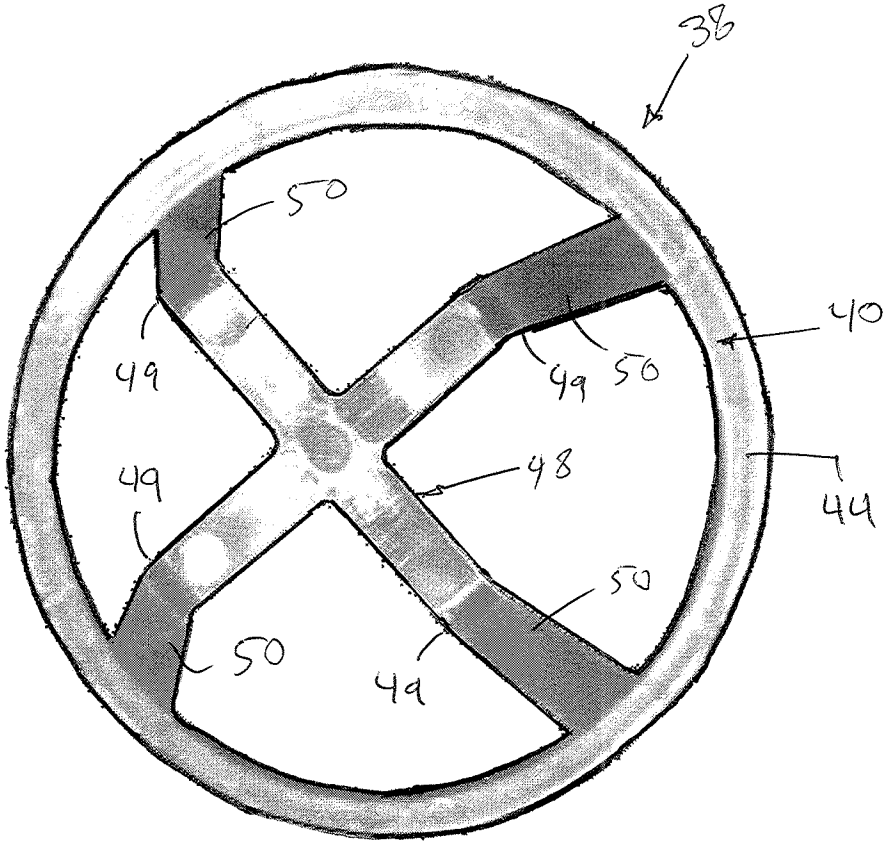
FIG. 5A illustrates a top plan view of a cage used in a cartridge according to the present invention.
Figure 5D:
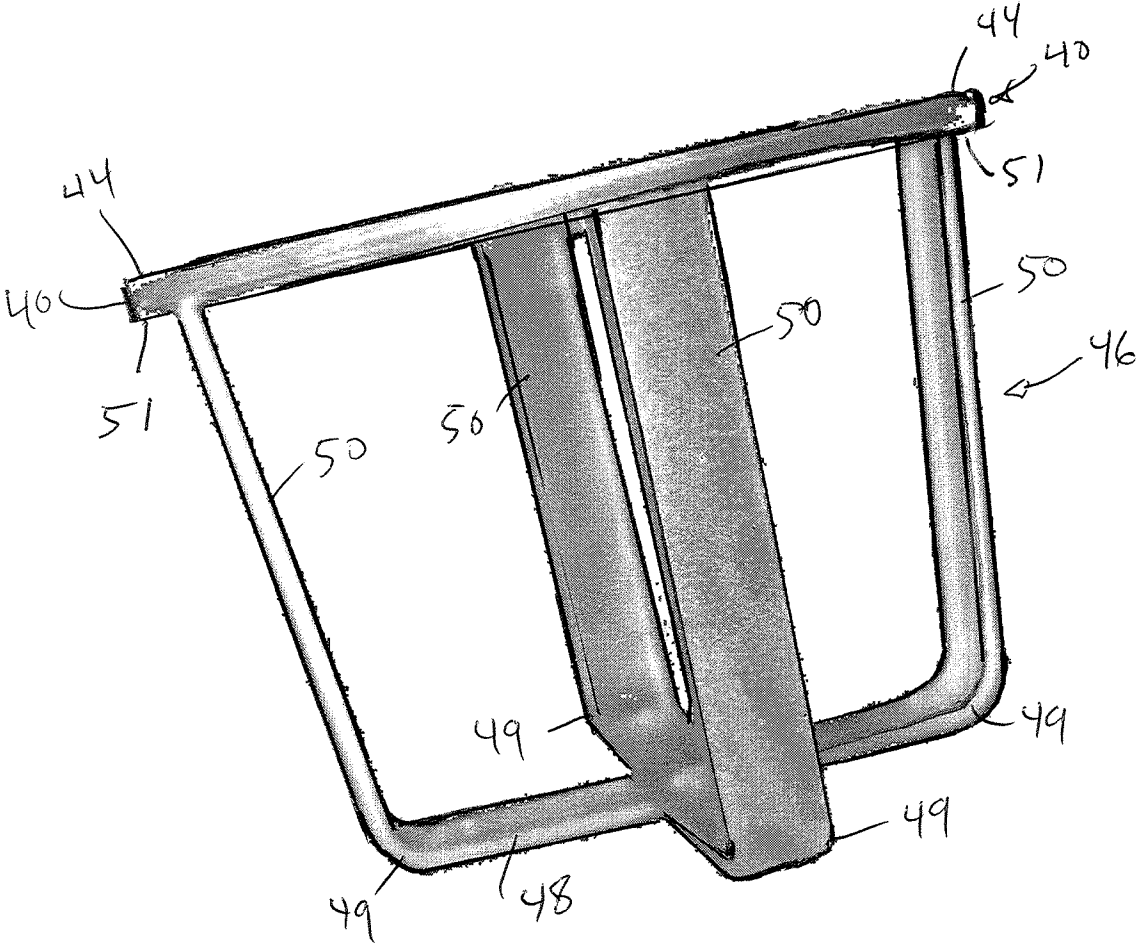
FIG. 5B illustrates a side, perspective view of a cage according to the present invention.

Referring to FIGS. 2-6, a cartridge 34 according to the present invention includes a cup 12 having substantially the same features as the cup illustrated in FIG. 1 and described earlier. Thus, a cartridge 34 according to the present invention includes a cup 12 having a frustoconical bottom portion 14 with a closed bottom 16 and an open top 18 defined by a top edge 19. An endless, annular wall 20 is joined at its bottom edge 22 to edge 19 of frustoconical bottom portion 14 via an intermediate, endless, annular flange portion 24. Annular wall 20 may be cylindrical, or it may be a frustum with its base joined with flange portion 26 as illustrated in FIG. 4. In an alternative embodiment, annular wall 20 may be an upside down frustum with a base joined with intermediate flange portion 24.

Intermediate flange portion 24 extends away (preferably radially away) from the interior of frustoconical bottom portion 14 and surrounds top edge 19 of frustoconical bottom portion 14. Wall 20 terminates at a top annular edge 21, which defines the open mouth of cup 12. Top edge 21 is joined with a top annular flange 26 that extends away from the interior of wall 20 in a radial direction. Cup 12 is a unitary body preferably made of a suitable plastic that is fluid impermeable and can be pierced at bottom 16 to allow the brewed beverage to exit in the manner described earlier.

A cartridge according to the present invention also includes a filter body 36 which is fluid permeable. A suitable material for fabrication of filter body 36 is 400 mesh netting polymeric material, preferably a nylon mesh, although other materials may be used. Filter body 36 is preferably a pouch or the like configuration although a cup-shaped (e.g. cone shaped) filter body 36 may also be used without deviation from the scope and spirit of the present invention.

While a cartridge according to the present invention includes a filter body 36 that receives a mass of brewable substance such as ground coffee, unlike the Keurig cartridge shown in FIG. 1 and described above, filter body 36 is not directly joined to the interior surface of cup 12. Rather, according to an aspect of the present invention, filter body 36 is joined to and supported by a cage 38, which is fully received inside of cup 12. Specifically, cage 38 is a unitary body preferably made from plastic (e.g. recycles PP) that includes a ring portion 40 having an outer diameter that is about the same as an interior diameter of wall 20 of cup 12. A top portion 42 of filter body 36 that includes its top edge is folded over and directly joined to the radially oriented top surface 44 of ring portion 40. The remaining portion of filter body 36 is received in the interior of ring portion 40 and extends into the interior of cage 38. The thickness of ring portion 40 is selected to be preferably less than the depth of wall 20 of cup 12, whereby ring portion 40 is fully received inside cup 12 and rests on intermediate flange portion 24. Filter body 36 is joined to top surface 44 by heat sealing or ultrasonic bonding (welding) or the like method.

Cage 38 preferably includes a lower portion 46 that includes a base section 48 and a plurality of spaced elongated connectors 50 that connect base section 48 to ring portion 40, thereby realizing an open frame to allow the entry and exit of fluid into and out of the interior of cage 38. In the preferred embodiment, base section 48 is made of a cross-shaped web of plastic, although other shapes are considered to be within the scope of the present invention. Each terminal end 49 of the cross-shaped web constituting base section 48 is integrated (joined with) with an end of a respective connector 50. The opposite end of each connector 50 is integrated (joined with) with ring portion 40. Preferably, each end of each connector 50 is joined with ring portion 40 at a location on bottom surface 51 of ring portion 40 at the interior annular wall of ring portion 40, which extends between top surface 44 and bottom surface 51, or at a location on the interior annular wall. In either case, connectors 50 are preferably thin enough and preferably join ring portion 40 such that ring portion 40 may rest on and be supported by intermediate flange portion 24 without interference from connectors 50. It should be noted that base section 48 is configured so that its longest dimension is smaller than the diameter of closed bottom 16, whereby, as illustrated in FIG. 4, connectors 50 converge toward base section 48 and one another. In the preferred embodiment cage 38 is a unitary body. It should be noted the in the preferred embodiment, the bottom of filter body 36 is joined to (by welding, fusion or the like) to base section 48, preferably at the center of the cross-shaped web section (location marked with numeral 53).

Because ring portion 40 has about the same outer diameter as an inner diameter of wall 20, ring portion 40 makes intimate contact (i.e. surface to surface contact) with the interior surface of wall 20 thus preventing hot water from seeping into frustoconical bottom portion 14 without passing through filter body 36. That is, ring portion 40 makes a good enough intimate contact with the interior surface of wall 20 to seal the space between foil 28 and upper ring portion 40 from frustoconical bottom portion 14, whereby hot water is directed through filter body 36. Note that preferably, top surface 44 of ring portion 40 does not reach the top edge of wall 20, i.e. does not reach the mouth of cup 12.

A cartridge according to the present invention further includes a foil 28 which is joined to top flange 26 to enclose the brewable substance that resides inside filter body 36 in the same manner as a Keurig cartridge depicted in FIG. 1 and described above.

A cartridge according to the present invention while different in configuration may be used in a machine as disclosed in U.S. Pat. No. 5,325,765.

A cage according to the present invention retards the sagging of filter body 36 and also reduces the likelihood of tearing and the ripping of filter body 36. Thus, the cartridge will be able to carry more coffee, which will allow for making more coffee from each cartridge (up to 20%).

Moreover, in use, the flow of the hot water from the brewer hits the base section of the cage (at or around the middle thereof in the preferred embodiment). The contact of water with the base section causes turbulence in the water inside of the cup resulting in the improved extraction of flavor from the coffee residing in the filter body. It has been experienced that a coffee brewed using a cage according to the present invention results in 15 to 20% more flavor from the same amount of coffee as the prior art. That is, after the brewing of the coffee the flavor is more intense given the same amount of coffee as the prior art.

Furthermore, a cage according to the present invention is recyclable, making it more environmentally friendly.

Filter body may be joined to the cage by employing a process similar to the process disclosed in U.S. patent application Ser. No. 13/594,079.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A cartridge for retaining a mass, comprising:

a fluid impermeable cup having an interior space, said cup including a bottom portion with a closed bottom and an open top defined by a top edge, and an annular wall terminating at an annular edge defining an open mouth for said cup, said annular wall including a bottom edge connected to said top edge of said bottom portion by an intermediate annular flange portion which extends away from an interior of said bottom portion;

a foil joined with the cup to close said open mouth; and a fluid permeable filter that retains a mass and is joined to a cage, wherein said filter and said cage are received entirely in said interior space to reside below said foil and above and spaced from said closed bottom, and said cage rests against an interior surface of said cup to support said filter inside said interior space, said cage including a ring portion, a partially open base section defined by crossing members, and a plurality of spaced connectors connecting said base section to said ring portion, wherein said filter is received interiorly of said ring portion, is connected to and supported by said ring portion and continuously extends from said ring portion toward and over said partially open base section, and wherein said ring portion includes a top surface, a bottom surface, the top surface and the bottom surface of said ring portion each has an outer diameter that enables said ring portion to make an intimate, surface to surface contact with an interior surface of said annular wall of said cup along a surface of said ring portion that extends between said top surface and said bottom surface.

2. The cartridge of claim 1, wherein said base section is cross-shaped.

3. The cartridge of claim 2, wherein each said connector includes one end connected to said base section and another end connected to said ring portion.

4. The cartridge of claim 3, wherein each connector is connected to a bottom surface of said ring portion that faces said base section at an interior annular surface of said ring section.

5. The cartridge of claim 3, wherein each connector is connected to an interior annular surface of said ring portion.

6. The cartridge of claim 1, wherein said cup includes a flange portion radially extending away from said annular edge, and said foil is joined with said flange.

7. The cartridge of claim 1, wherein said filter and said cage are discrete bodies, and said filter is joined to said top surface of said ring portion.

8. The cartridge of claim 7, wherein said filter is a mesh.

9. The cartridge of claim 7, wherein said filter is a pouch, and said base section retards sagging of said filter.

10. A retainer for retaining a mass inside of a cup, comprising:

a cage; and a fluid permeable filter joined to said cage, wherein said cage is configured to be received inside said cup and configured to be supported inside said cup, wherein said cage consists of a ring portion, a partially open base section defined by a cross-shaped web having four terminal ends, and four spaced connectors connecting said base section to said ring portion, each connector having an end connected to said ring portion and an opposite end connected to a respective terminal end of said cross-shaped web, and wherein said fluid permeable filter is received interiorly of said ring, includes a top portion that is joined to an upper, annular surface of said ring portion, and extends continuously from said upper annular surface of said ring toward and over said partially open base section of said cage, and wherein said ring portion is sized to make intimate, surface to surface contact with an interior annular wall of said cup.

11. The retainer of claim 10, wherein said ring portion has an outer diameter sized so that said ring portion makes intimate contact with an interior surface of an annular wall of said cup.

12. The retainer of claim 10, wherein said cage is comprised of plastic.

13. The retainer of claim 10, wherein each connector is connected to a bottom surface of said ring portion that faces said base section at an interior annular surface of said ring section.

14. The retainer of claim 10, wherein each connector is connected to an interior annular surface of said ring portion.

* * * * *